US006132233A

United States Patent [19]

Fukuda

[11] Patent Number: 6,132,233

[45] Date of Patent: Oct. 17, 2000

[54] LOCK ARM PROTECTION STRUCTURE FOR CONNECTORS

[75] Inventor: Masaru Fukuda, Shizuoka, Japan

[73] Assignee: Yazaki Corporation, Tokyo, Japan

[21] Appl. No.: 09/213,408

[22] Filed: Dec. 17, 1998

[30] Foreign Application Priority Data

Dec. 19, 1997 [JP] Japan ..... 9-350741

[51] Int. Cl.[7] ..... H01R 13/627

[52] U.S. Cl. ..... 439/357; 439/352

[58] Field of Search ..... 439/350–358

[56] References Cited

U.S. PATENT DOCUMENTS 4,986,766 1/1991 Leonard et al. ..... 439/352
5,624,271 4/1997 Childs et al. ..... 439/352

FOREIGN PATENT DOCUMENTS 0 762 558 A2 3/1997 European Pat. Off. .
35 26 353 A1 2/1987 Germany .
2-112180 4/1990 Japan .

*Primary Examiner*—Brian Sircus
*Assistant Examiner*—Eugene G. Byrd
*Attorney, Agent, or Firm*—Armstrong, Westerman, Hattori, McLeland & Naughton

[57] ABSTRACT

A lock arm protection structure is provided. In this structure, a cantilevered lock arm is formed on an outer wall surface of the housing main body of a connector to be locked to a mating connector. A cantilevered holding arm is also formed on the outer wall surface and extends in the engagement direction. The holding arm covers the lock arm to prevent it from hooking a wire harness being moved. The free end of the lock arm is covered with the free end of the holding arm, so that the lock arm bends when the holding arm bends. The holding arm is provided with nonslip steps. The lock arm stands from the engagement side of the housing main body, while the holding arm stands from the terminal insertion side of the housing main body. The free ends of the lock arm and the holding arm both extend to the middle of the outer wall surface.

5 Claims, 5 Drawing Sheets

LOCK ARM PROTECTION STRUCTURE FOR CONNECTORS

BACKGROUND OF THE INVENTION

1. Field of the Invention

The present invention relates to a structure for protecting a lock arm for connectors.

2. Description of the Related Art

Conventionally, to engage a connector with a mating connector, a lock arm is formed on the connector, and a lock slit for receiving the stopper protrusion of the lock arm is formed in the mating connector. Before engagement, however, the wires of wire terminals inserted into the connector are often hooked by the lock arm, which damages the lock arm.

To prevent such damage to the lock arm, Japanese Patent Laid-Open No. 2-112180 discloses a lock arm protection structure as shown in FIG. 7.

In this lock arm protection structure, a cantilevered lock arm 62 stands on the upper wall surface 61*a* of the housing main body 61, and protection walls 63 stand on both sides of the free end of the lock arm 62, as shown in FIG. 7. With this structure, however, the wires of wire terminals (not shown) or a wire harness (not shown) cannot be effectively prevented from being hooked.

Japanese Patent Laid-Open No. 2-112180 discloses another lock arm protection structure. As shown in FIG. 8, a protection frame 64 stands on the upper wall surface 61*a* of the housing main body 61, surrounding the free end 62*a* of the lock arm 62. In this structure, however, a movement range (flexible range) of the free end 62*a* of the lock arm 62 is restricted by the protection frame 64, which results in poor workability in the unlocking process.

FIG. 9 shows yet another lock arm protection structure. In this figure, a three-point fixed lock arm 66 is formed on the upper wall surface 61*a* of the housing main body 61. One end 65*a* of the lock arm 66 stands from the engagement side, and the two other ends 65*b* and 65*c* of the lock arm 66 stand from the side of insertion of wire terminals (not shown). However, since the three ends 65*a* to 65*c* are fixed, the lock arm 66 does not bend enough. As a result, whether the connector is completely locked to the mating connector cannot be felt.

SUMMARY OF THE INVENTION

The principal object of the present invention is to provide a lock arm protection structure for connectors, with which the lock arm can be prevented from being damaged in the engaging process, whether the connectors are completely locked to each other can be easily felt, and workability in the unlocking process can be improved.

To achieve the above object, the present invention provides a connector lock arm protection structure which comprises a cantilevered lock arm formed on the outer wall surface of the housing main body of a connector to be connected to a mating connector by a locking mechanism, and a cantilevered holding arm formed on the outer wall surface and extending in a direction of engagement. The holding arm covers the lock arm so as to prevent a wire harness from being hooked by the lock arm when the wire harness is moved around during an operation. Thus, the lock arm can be prevented from being damaged.

The free end of the lock arm is covered with the free end of the holding arm, so that the lock arm bends as the holding arm is pushed toward the outer wall surface. Thus, the lock arm can be automatically unlocked by bending the holding arm after locking.

Since the free end of the lock arm is covered with the holding arm, the bending direction of the lock arm is not restricted by the holding arm. Because of this, whether a connector and a mating connector are completely locked to each other can be felt by an operator more certainly than in the prior art.

The holding arm is provided with nonslip steps, so that the operator can easily and surely place a finger onto the holding arm. This ensures that an external force from a finger is always exerted on the same place on the holding arm.

The lock arm stands from the engagement side of the housing main body, while the holding arm stands from the terminal insertion side of the housing main body. The free ends of the locking arm and the holding arm both extend toward the middle of the outer wall surface. Thus, the flexible ranges of the lock arm and the holding arm can be substantially the same as those in the prior art. Also, the flexible range of the lock arm can be large enough without making the housing main body larger in size.

The above and other objects and features of the present invention will become more apparent from the following description taken in conjunction with the accompanying drawings.

DESCRIPTION OF THE PREFERRED EMBODIMENTS

The following is a detailed description of the preferred embodiments of the present invention, with reference to the accompanying drawings.

Figure 1:
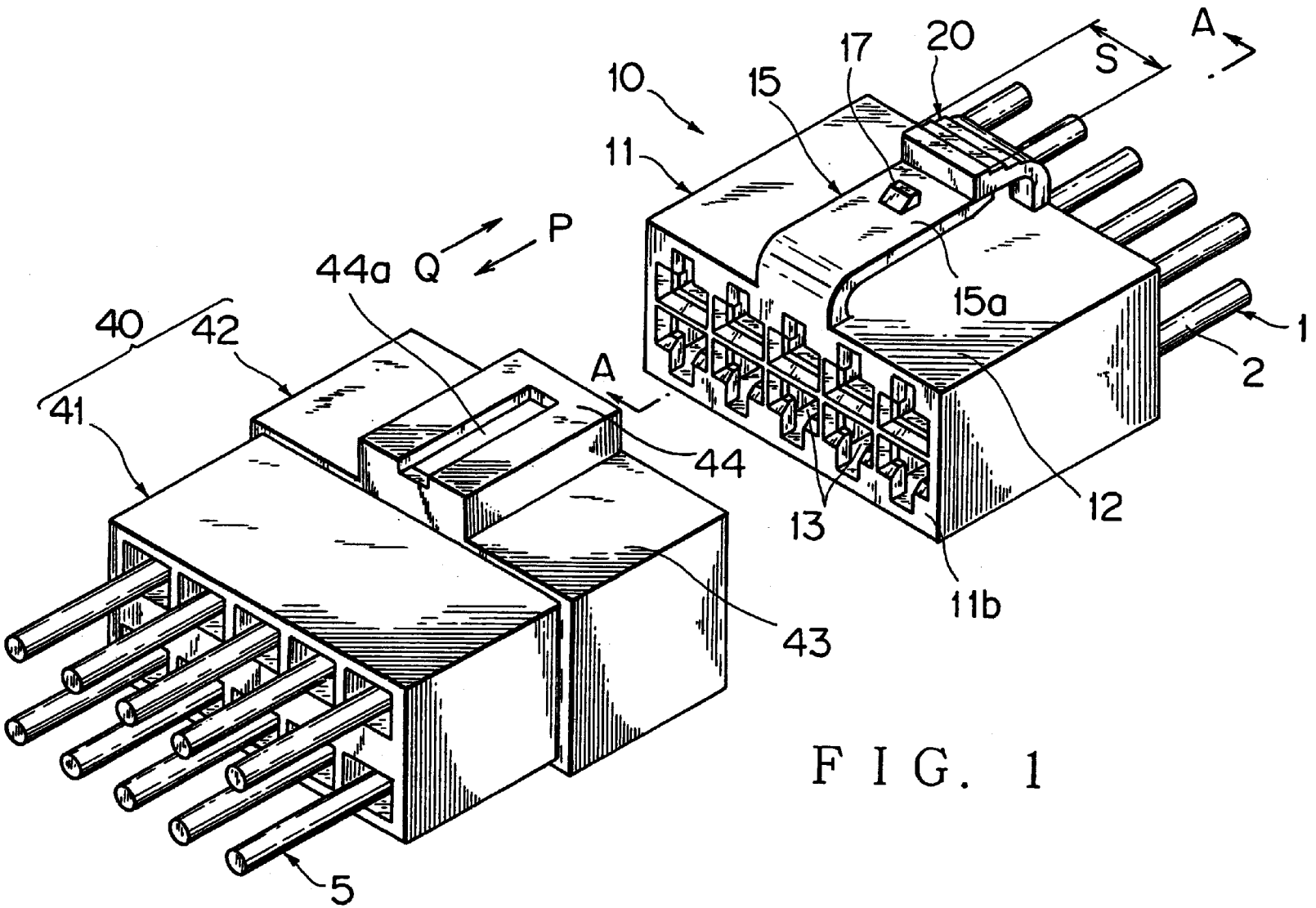
FIG. 1 is a perspective view of one embodiment of the entire lock arm protection structure for connectors according to the present invention.

FIGS. 1 to 6 illustrate one embodiment of the lock arm protection structure according to the present invention. In FIG. 1, the lock arm protection structure is provided with a holding arm 20 for protecting a lock arm 15. The holding arm 20 is disposed on the upper wall surface 12 (outer wall surface in the claims) of the housing main body 11 of a male connector 10 in the direction (direction P) of engagement of the male connector 10 and a female connector 40.

Figure 2:
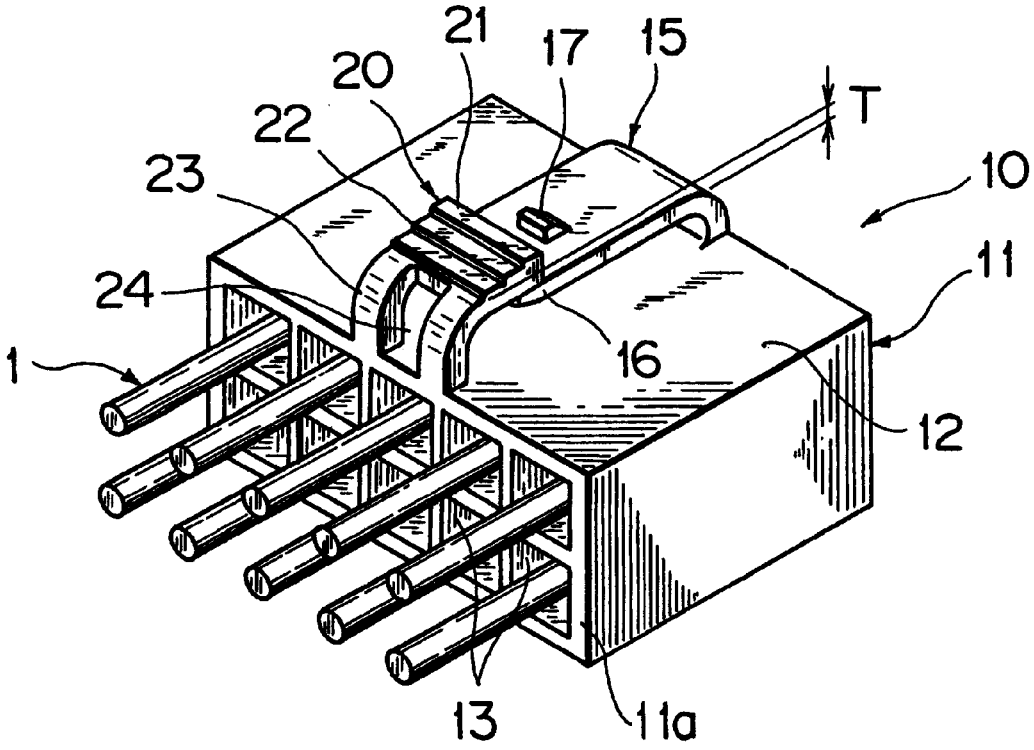
FIG. 2 is a perspective view of a connector of FIG. 1 seen from the opposite side.
Figure 3:
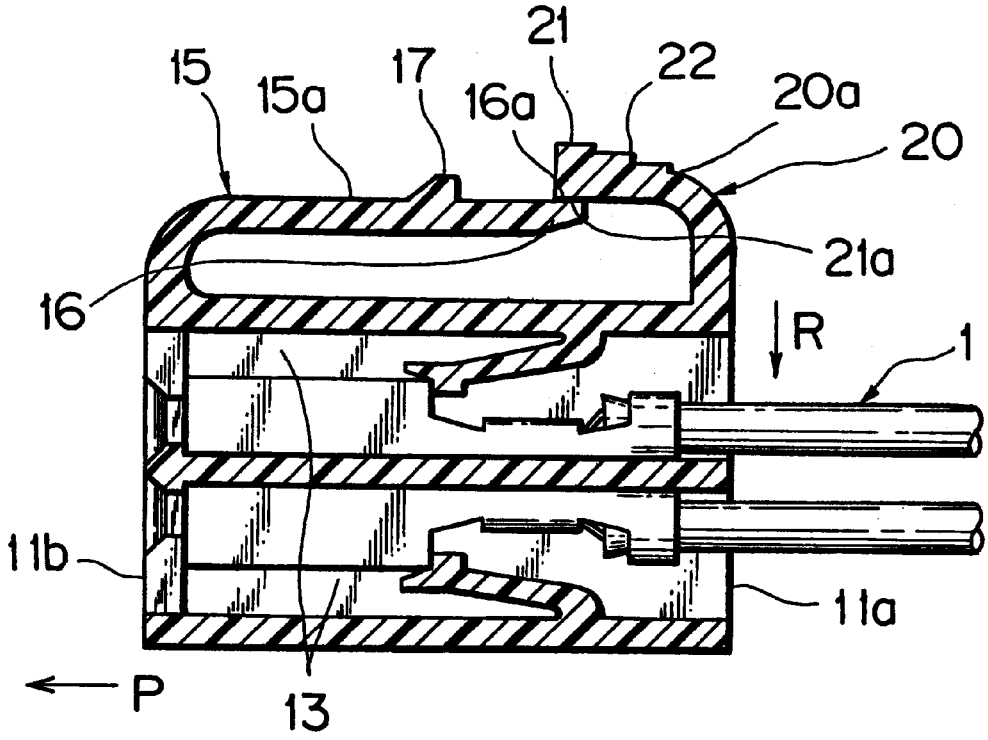
FIG. 3 is a sectional view of the lock arm protection structure taken along the line A—A of FIG. 1.

As shown in FIGS. 1 to 3, on the upper wall surface 12 of the housing main body 11, the cantilevered lock arm 15 stands at the engagement side and extends in the opposite direction (direction Q) to the engagement direction (direction P). The cantilevered holding arm 20 stands at the insertion side of wire terminals 1 and extends in the engagement direction (direction P). The holding arm 20 and the lock arm 15 are arranged on a straight line. A plurality of receiving chambers 13 for accommodating the wire terminals 1 are formed in the housing main body 11. The receiving chambers 13 extend from one side wall 11*a* to the other side wall 11*b*.

In natural circumstances where no external force is exerted, the free end 21 of the holding arm 20 covers and is in contact with the free end 16 of the lock arm 15. More specifically, the lower wall surface 21*a* of the free end 21 of the holding arm 20 is in contact with the upper wall surface 16*a* of the free end 16 of the lock arm 15. With such a structure, the free end 21 of the holding arm 20 does not interfere with the free end 16 of the lock arm 15 when the lock arm 15 bends or returns to the original position.

Due to the positional relationship between the holding arm 20 and the lock arm 15, there is no restriction on movement of the free end 16 of the lock arm 15 (i.e., the lock arm 15 is movable at the free end 16). Because of this, whether the male connector 10 and the female connector 20 are completely locked or not can be more easily felt.

Since the free end 21 of the holding arm 20 is situated above and in contact with the free end 16 of the lock arm 15, the free end 16 of the lock arm 15 displaces downward (direction R) following the movement of the holding arm 20 when the holding arm 20 is pushed downward (direction R) after engagement of the male connector 10 and the female connector 40. Thus, the connectors 10 and 40 can be readily unlocked.

Nonslip steps 22 are formed on the upper wall surface 20*a* of the holding arm 20. With the nonslip steps 22, the holding arm 20 can be easily and surely hooked by a finger so as to push the free end 21 downward (direction R). A slit 24 through which a mold (not shown) is pulled out is formed at the base 23 of the holding arm 20.

The width S and the thickness T of the holding arm 20 is substantially the same as those of the lock arm 15. A stopper protrusion 17 is formed on the upper wall surface 15*a* of the lock arm 15. The stopper protrusion 17 is disposed so as not to interfere with the holding arm 20.

The female connector 40 (mating connector in the claims) comprises a hood 42 which expands from the side walls of the housing main body 41 toward the male connector 10, and an arm receiving chamber 44 formed on the upper wall 43 of the hood 42. The arm receiving chamber 44 is made large only enough to accommodate the lock arm 15 of the male connector 10. The chamber 44 has an engaging slit 44*a* for receiving the stopper protrusion 17 formed on the lock arm 15.

By accommodating the male connector 10 in the hood 42, the male connector 10 and the female connector 40 are engaged with each other. At the same time, the stopper protrusion 17 of the lock arm 15 is also engaged with the engaging slit 44*a*. Thus, the wire terminals 1 and 5 inside the male connector 10 and the female connector 40 are electrically connected.

As can be seen from FIG. 1, the wire terminals 1 are inserted into and secured in receiving holes 13 in the housing main body 11, thereby forming the male connector 10. After securing the wire terminals 1, even if the wires 2 of the wire terminals 1 or the wire harness (not shown) for the wires 2 are moved around, external force is shut by the holding arm 20 and will not reach the free end 16 of the lock arm 15. Thus, the lock arm 15 can be completely prevented from being damaged.

Figure 4:
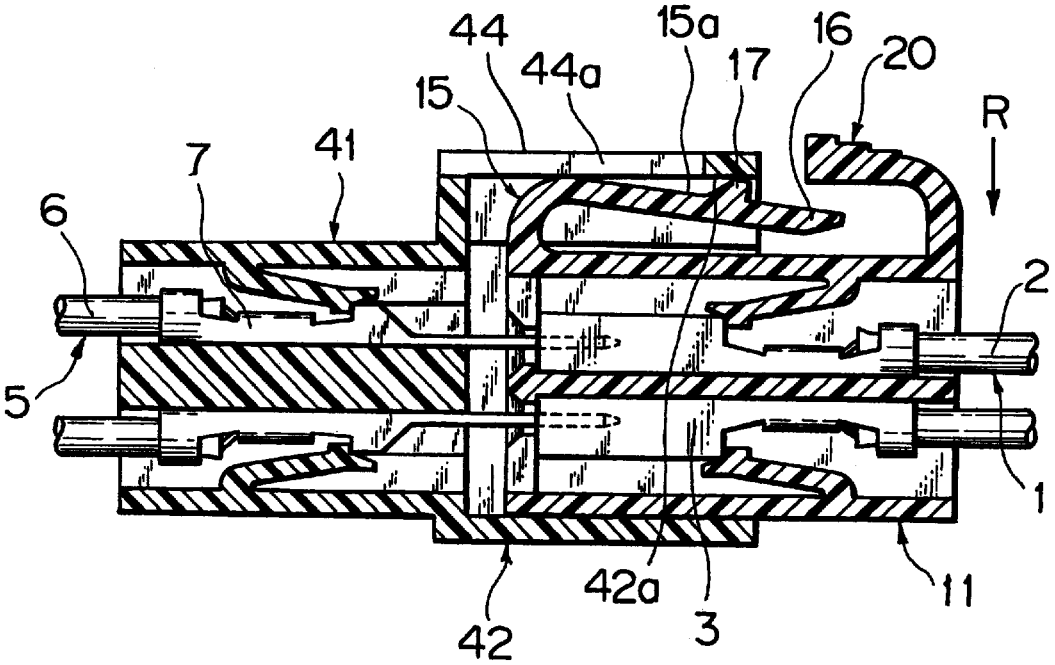
FIG. 4 is a sectional view of the male and female connectors of FIG. 1 prior to engagement.

As shown in FIG. 4, the male connector 10 is inserted into the hood 42 of the female connector 40, so that the male connector 10 and the female connector 40 are engaged with each other. In the engaging process, as the lock arm 15 bends downward, the upper wall surface 15*a* of the lock arm 15 slides on the inner surface 42*a* of the hood 42. The stopper protrusion 17 of the lock arm 15 passes along the inner surface 42*a* of the hood 42, and then enters the engaging slit 44*a*. Thus, the lock arm 15 returns to the normal state, and fits in the arm receiving chamber 44.

At the same time, the male terminals 3 and the female terminal 7 inside the male connector 10 and the female connector 40 are electrically connected, thereby completing the engaging process of the male connector 10 and the female connector 40.

Figure 5:
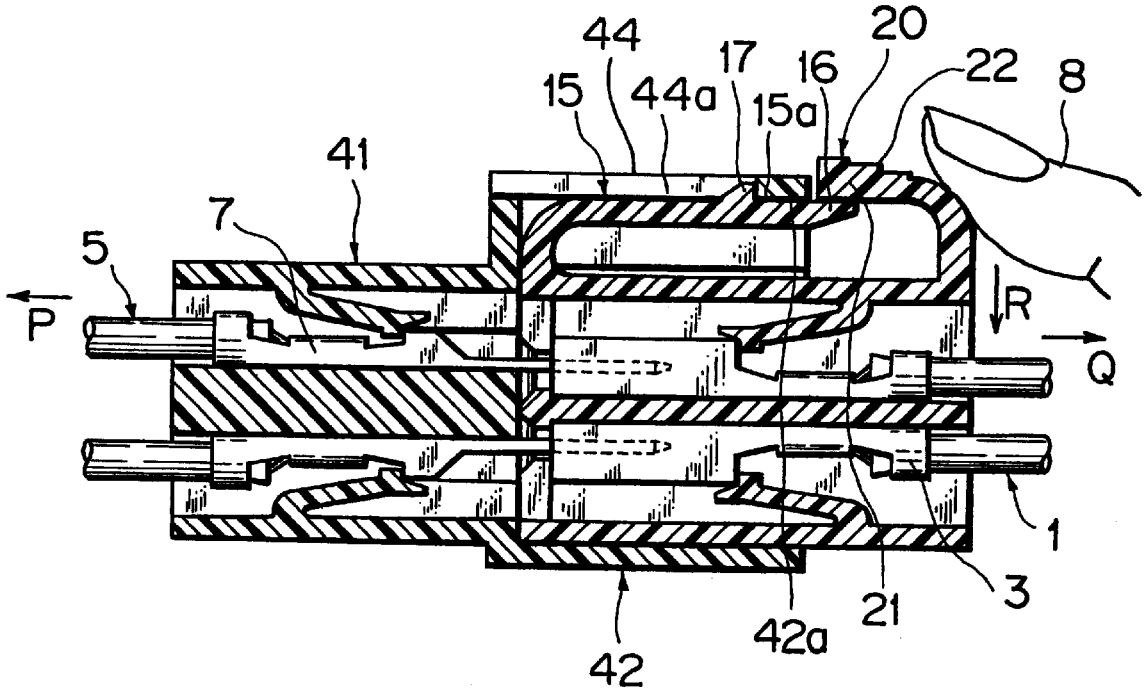
FIG. 5 is a sectional view of the male and female connectors of FIG. 4 after engagement.

To disengage the male connector 10 and the female connector 40 from each other, the nonslip steps 22 of the holding arm 20 are pushed downward (direction R), as shown in FIG. 5. As the free end 21 of the holding arm 20 moves downward (direction R), the lock arm 15 follows the movement and bends downward (direction R). Here, there is no need to push the lock arm 15 to release the stopper protrusion 17 from the engaging slit 44*a*. After the release of the stopper protrusion, the male connector 10 and the female connector 40 can be easily disengaged from each other by simply pulling them in opposite directions (direction Q and direction P). In the figure, reference numeral 8 indicates a finger of an operator.

Figure 6:
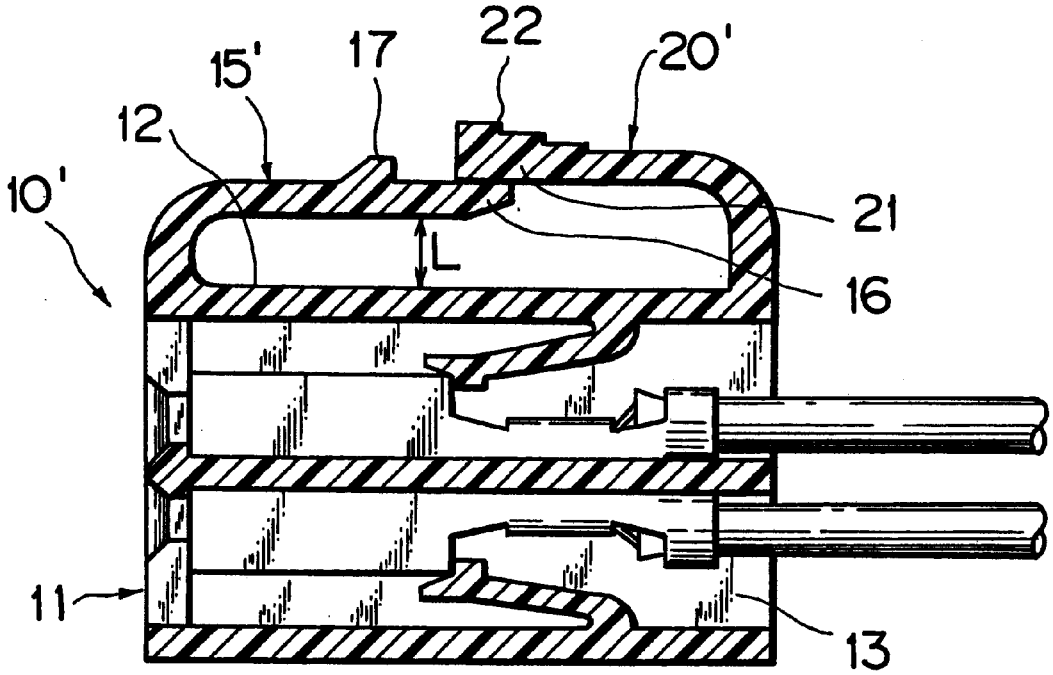
FIG. 6 is a sectional view illustrating a modification of the lock arm protection structure for connectors according to the present invention.
Figure 7:
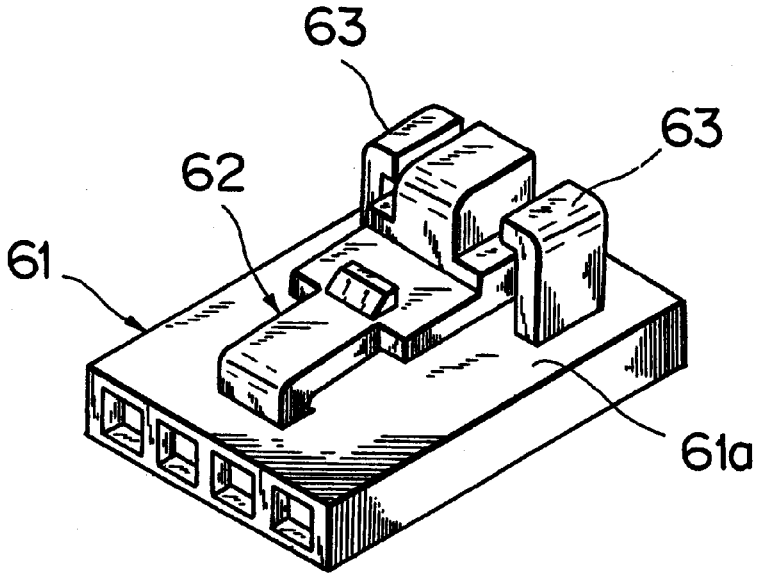
FIG. 7 PRIOR ART
FIG. 7 is a perspective view of a connector of the prior art.
Figure 8:
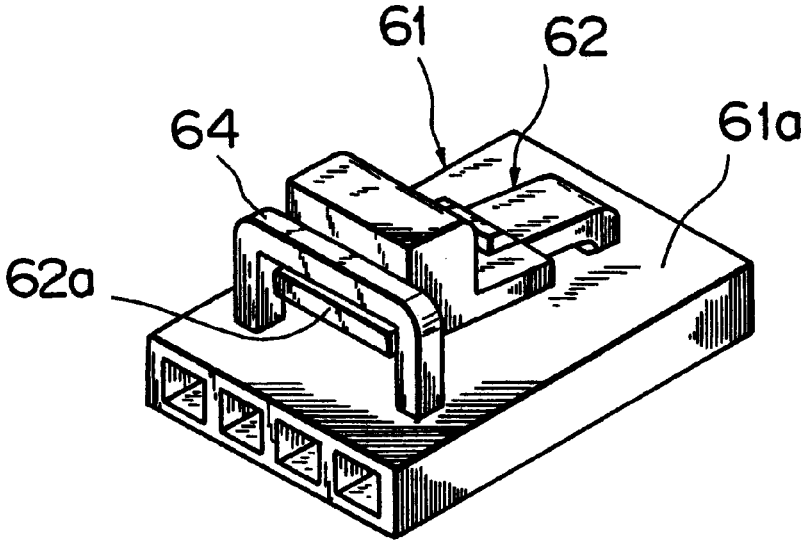
FIG. 8 PRIOR ART
FIG. 8 is a perspective view of another connector of the prior art.
Figure 9:
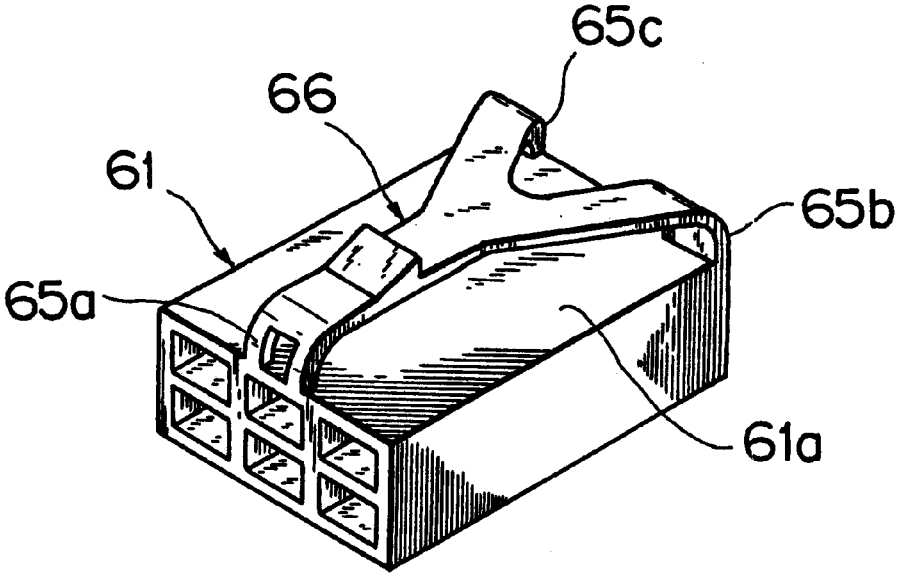
FIG. 9 PRIOR ART
FIG. 9 is a perspective view of yet another connector of the prior art.

FIG. 6 illustrates a modification of the embodiment. As shown in the figure, a holding arm 20' and a lock arm 15' extends substantially to the middle of the upper wall surface 12. With this structure, the flexible range (flexible length) L for the lock arm 15' can be maintained substantially as the same as in the prior art. This eliminates the need to produce a large housing main body 11 only to maintain enough flexible range L for the lock arm 15'.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A lock arm protection structure for connectors, comprising:

a cantilevered lock arm, having a free end, formed on an outer wall surface of a housing main body of a connector to be connected to a mating connector by a locking mechanism; and a cantilevered holding arm, having a free end, formed on the outer wall surface and extending in a direction of engagement;

wherein the free end of the holding arm covers the free end of the lock arm.

2. The lock arm protection structure according to claim 1, wherein said lock arm stands from an engagement side of the housing main body, while said holding arm stands from a terminal insertion side of the housing main body.

3. The lock arm protection structure according to claim 2, wherein said lock arm bends as said holding arm is pushed downward.

4. The lock arm protection structure according to claim 3, wherein said holding arm is provided with nonslip steps.

5. The lock arm protection structure according to claim 1, wherein said lock arm stands from engagement side of the housing main body, while said holding arm stands from a terminal insertion side of the housing main body, and the free end of said holding arm and the free end of said lock arm both extend substantially to the middle of the outer wall surface.

* * * * *